US006041558A

United States Patent [19]

Sylvestre

[11] Patent Number: 6,041,558

[45] Date of Patent: Mar. 28, 2000

[54] COLLAPSIBLE TOWER SYSTEM FOR ANTENNA OR THE LIKE

[75] Inventor: David P. Sylvestre, Canterbury, Conn.

[73] Assignee: SRS Communications Corp., West Hartford, Conn.

[21] Appl. No.: 08/944,237

[22] Filed: Oct. 6, 1997

[51] Int. Cl.[7] ..... E04H 12/34; E04H 12/18

[52] U.S. Cl. ..... 52/111; 52/121

[58] Field of Search ..... 52/111, 121

[56] References Cited

U.S. PATENT DOCUMENTS 4,580,377 4/1986 Sundin ..... 52/121

*Primary Examiner*—Beth Aubrey

*Attorney, Agent, or Firm*—McCormick, Paulding & Huber LLP

[57] ABSTRACT

The antenna mast or tower structure includes a base adapted for attachment to a van, preferably a van equipped with suitable mounting jacks designed to support the base. Both the base and the plurality of telescopically nested tubular subassemblies are adapted to be extended by cables, each cable being secured at one end to a lower end of the subassembly to be raised, and at its other end to a motorized cable and pulley system that includes a driven drum, plurality of fixed pulley blocks mounted to each subassembly near the upper end thereof, and a movable pulley block arranged to achieve a mechanical advantage in the cable and pulley system itself.

8 Claims, 4 Drawing Sheets

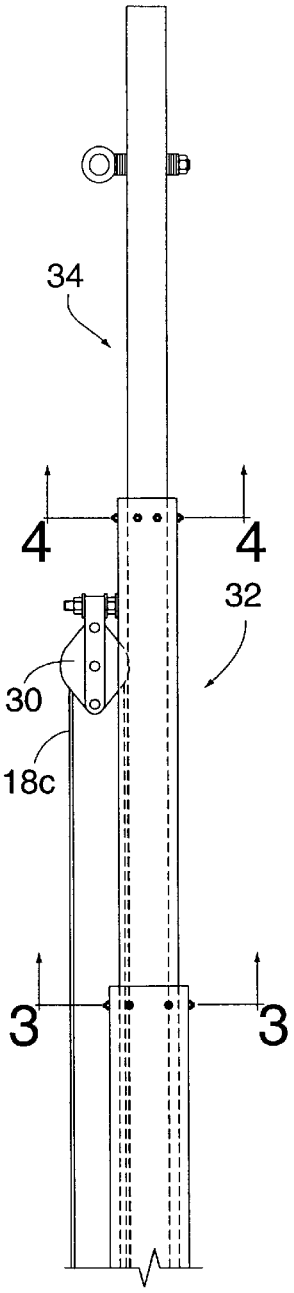
FIG. 1A
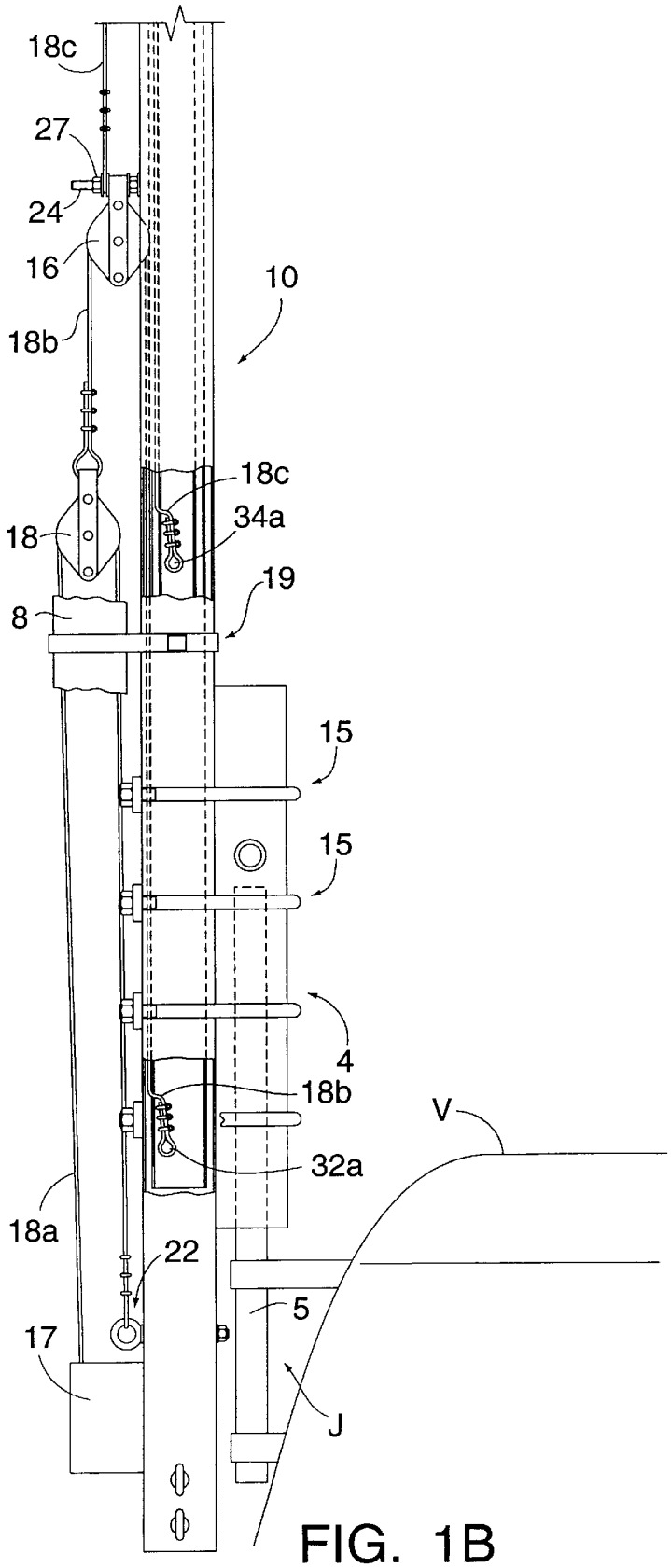
FIG. 1B
| FIG. 1A |
|---|
| FIG. 1B |
FIG. 1

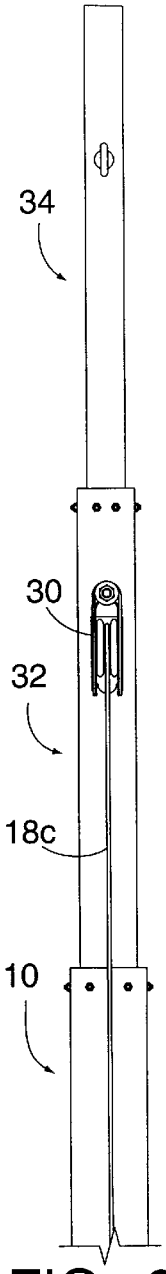
FIG. 2A
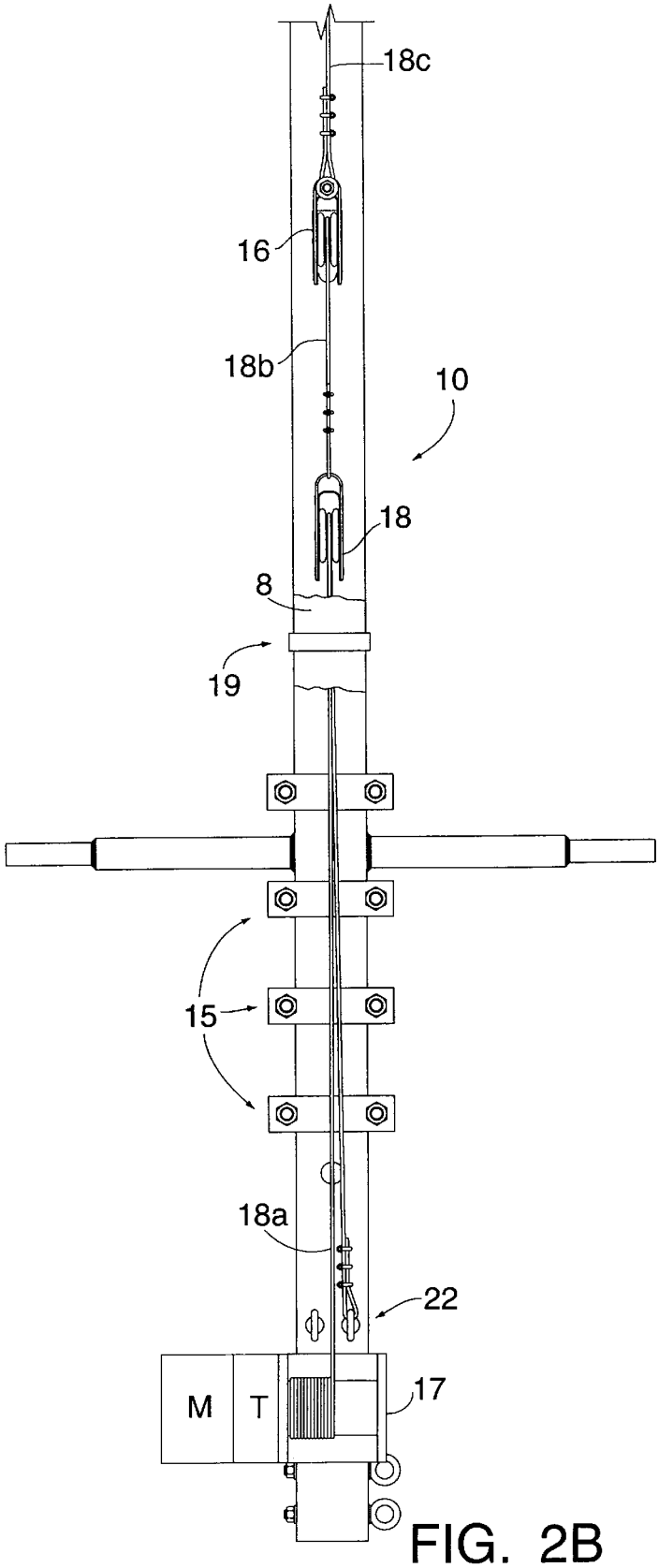
FIG. 2B
| FIG. 2A |
|---|
| FIG. 2B |
FIG. 2

COLLAPSIBLE TOWER SYSTEM FOR ANTENNA OR THE LIKE

This invention relates generally to collapsible towers of the type adapted to be mounted on a van that carries communications equipment, and that requires use of an antenna in conjunction with that equipment.

SUMMARY OF THE INVENTION

The present invention provides a collapsible tower for use with a van, the tower comprising telescopic sections that are readily raised and lowered by means of a winch.

In accordance with the present invention, the collapsible tower structure includes a tubular base assembly having an upper end for slidably receiving at least a second tubular subassembly, and preferably including still a third tubular subassembly received in the second subassembly.

The winch is mounted on the base assembly and a first cable has one end wrapped on the winch drum. The other end of the first cable passes around a movable pulley block provided on one end of a second cable. The opposite end of the first cable is secured to the base assembly providing a mechanical advantage to the second cable. The second cable passes over the fixed pulley block so that its opposite end can be secured to the lower end of the second tubular subassembly.

The second subassembly is adapted to be raised by the winch through the medium of this first cable and the second cable is more particularly provided with its opposite end inside the tubular base assembly and alongside the second tubular subassembly to be secured to the lower end of the second tubular subassembly for lifting the latter as the winch is operated.

Finally, a third subassembly is similarly raised and lowered by reason of a third cable provided around a pulley provided on the third subassembly, the ends of the third cable being connected, on the one hand, to the base subassembly, and on the other hand, to the lower end of the third tubular subassembly. Thus, these second and third subassemblies can be conveniently raised and lowered together in the base assembly by the same winch. An antenna is provided at the top of the Nth subassembly which may be the third subassembly in the hereinafter described embodiment.

BRIEF DESCRIPTION OF THE DRAWINGS

A more complete understanding of the invention and many of the attendant advantages will be readily appreciated as the same becomes better understood with reference to the following detailed description when considered in conjunction with the accompanying drawings, wherein:

FIG. 1A and FIG. 1B are a composite view a side elevational view of the tower structure of the present invention, in the process of being extended or raised to its fully deployed position. This tower structure is shown with reference to a van of the type which would require a collapsible antenna tower.

FIG. 2A and FIG. 2B are a composite view an end view of the tower structure illustrated in FIG. 1.

DETAILED DESCRIPTION

Figure 3:
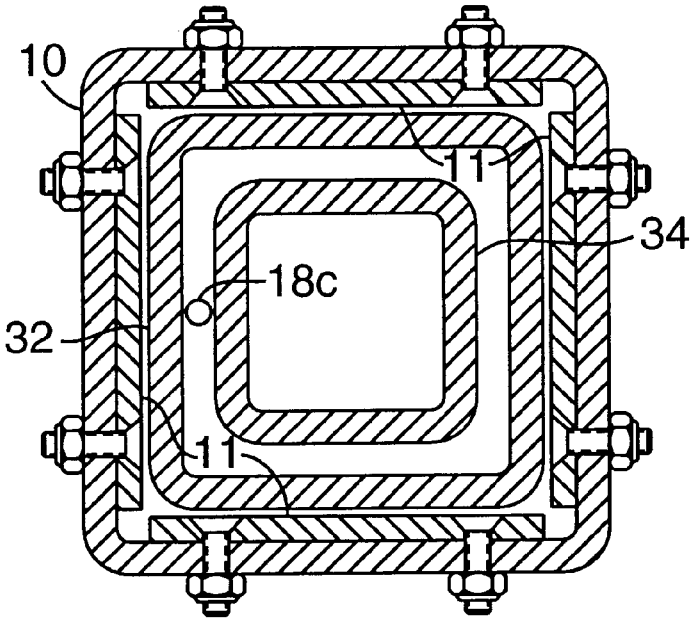
FIG. 3 is a sectional view taken along the line 3,3 of FIG. 1.

Turning now to the drawings in greater detail, FIGS. 1 and 2 illustrate, in overall elevation, the configuration for a collapsible or extendible tower constructed in accordance with the present invention, and suggest one possible environment for such a structure as mounted on the exterior of a conventional communications van or the like V. An antenna structure (not shown) is provided at the top of the tower's uppermost telescoping tubular segment or subassembly, and a suitable adaptor subassembly may be provided for supporting a conventional antenna for this purpose.

The van is of conventional configuration and may include suitable mounting jacks, for receiving a subassembly, indicated generally at 4 in FIG. 2. This subassembly 4 may include a projecting post as indicated at 5 which is also adapted for mounting the tower structure to the van.

The tower structure includes a tubular base assembly, indicated generally at 10, that may be secured to the subassembly 4 by U bolts as indicated generally at 15. Thus, van V has the tower structure base assembly 10 secured to it as shown in FIGS. 1 and 2.

In accordance with the present invention, the tubular base assembly 10 has a winch 17 mounted to its lower end, and a first cable 18*a* is provided around the drum of the winch so as to be provided around a movable pulley block 18 and thence, to extend downwardly to be secured to an eye bolt, such as that indicated generally at 22 mounted immediately above the winch 17 adjacent the lower end of the base subassembly 10. A protective cover 8 may be provided around the first cable 18*a* for the protection of those in the vicinity of the van and tower especially during extension and/or collapsing of the tower's telescopic tubular subassemblies.

Still with reference to the tubular base assembly 10, the cover 8 is supported on this tubular base assembly by brackets, as indicated generally at 19 (one shown). The movable pulley block 18 can be seen to provide a mechanical advantage as between the first cable 18*a* associated with the winch 17 and a second cable 18*b* provided between movable pulley block 18 and a second pully block 16. A second tubular subassembly 32 is telescopically received inside the upwardly open end portion of the base subassembly 10. The opposite end of the second cable 18*b* is secured to the lower end of the second tubular subassembly 32 as shown at 32*a*.

Figure 6:
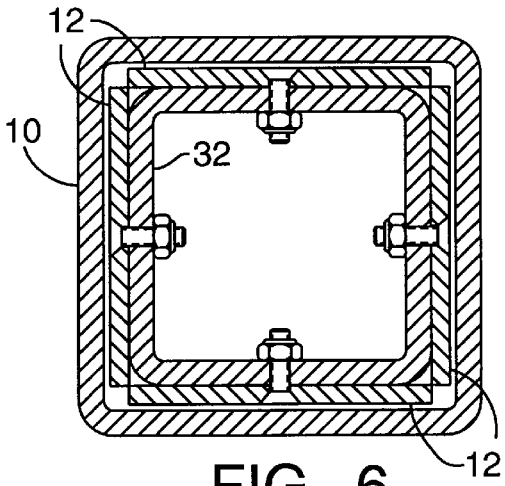
FIG. 6 is a sectional view taken through the lower end of the same tubular subassembly as shown in FIG. 5.
Figure 7:
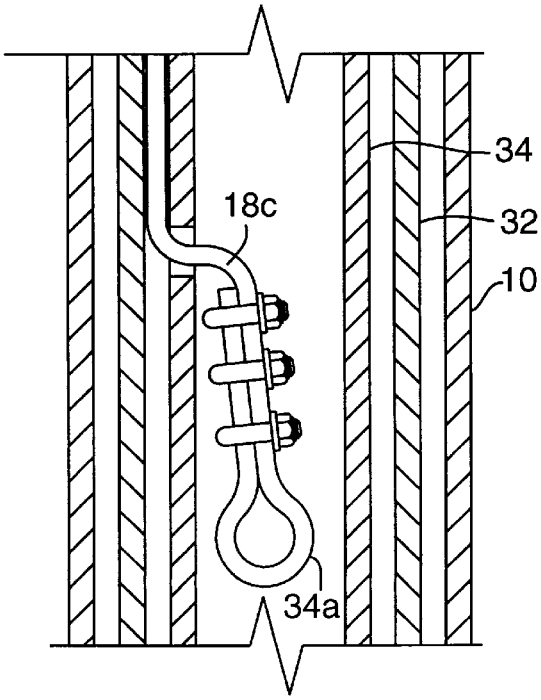
FIG. 7 is a sectional view through the lower end of a tubular subassembly and shows the preferred means for securing a cable thereto.

As best shown in FIGS. 3 and 6, this second tubular subassembly 32 is supported for relatively smooth slidable motion inside the tubular subassembly 10, and nylon or teflon plates 11 and 12 are provided on the inside and outside of these tubular elements as suggested in FIGS. 3 and 6 respectively. As so constructed and arranged, the second tubular subassembly 32 can be slid within the base tubular subassembly 10 with only the effort required to raise the movable subassembly 32 against the force of gravity.

Figure 4:
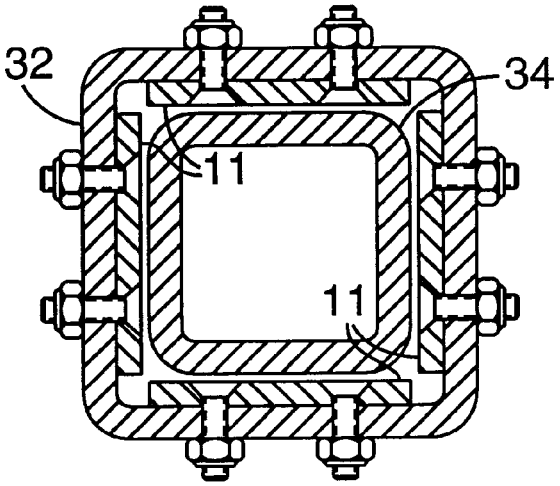
FIG. 4 is a sectional view taken along the line 4,4 of FIG. 1.
Figure 5:
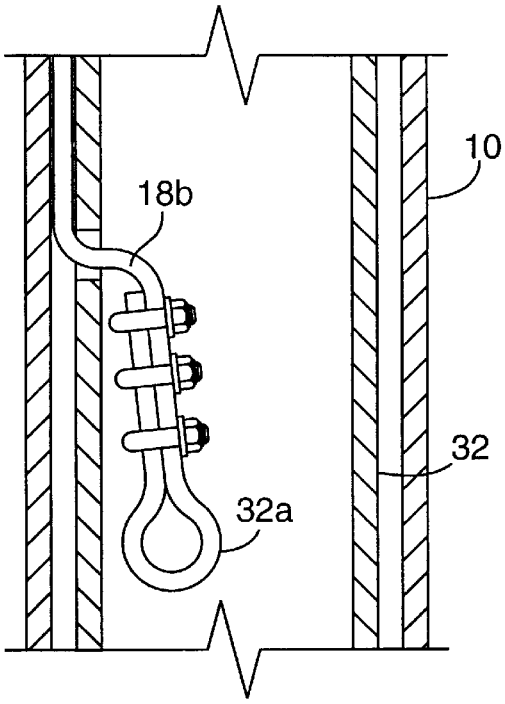
FIG. 5 is a sectional view through the lower end of the first telescoping tubular subassembly to illustrate the matter of attachment for the cable that raises said tubular subassembly.

A third cable 18*c* has one end secured to the base assembly 10 intermediate its ends as shown by post 24 and fasteners 27. This third cable 18*c* is passed over a fixed pulley block 30 so that its opposite end can be run between the tubular subassemblies 32 and 34 and connected to the lower end of the latter as shown at 34*a*. Slide bearings such as shown in FIGS. 3 and 4 support this additional subassembly in the second subassembly 32.

The top of subassembly 34 may be fitted with an antenna (not shown) or may itself be used to slidably support still another tubular subassembly. Additional cable (not shown) could be provided from the lower end 34*a* of this subassembly 34 around a fixed third pulley block (not shown) at its upper end to the post 24 on base assembly 10 in the event that a taller tower structure is required.

Although not specifically shown, the winch may comprise a simple windlass so as to be operated by a removable hard crank (not shown). Alternatively, the winch is electrically driven from an electric motor M that also serves as an electromagnetic brake when the winch is not being driven. A transmission may be provided between the motor and drum as shown at T.

I claim:

1. A rapidly extendible and retractable antenna mast structure comprising:

an elongated base assembly of tubular cross-section and having a lower end and an upper end defining an elongated upwardly open cavity, means for mounting said base assembly to a vehicle, windlass means mounted to said base assembly, and a fixed pulley block secured to said base assembly intermediate said lower and upper ends thereof, a first cable having one end secured to said windlass means, and a movable pulley between said windlass means and said fixed pulley block, said first cable provided around said movable pulley of said movable pulley, and said first cable having an end opposite said one end secured to said lower end of said base assembly, a second cable having one end secured to said movable pulley block, said second cable provided over said fixed pulley, and said second cable having an opposite end inside said elongated cavity of said base assembly, a second elongated tubular subassembly slidably received in said elongated cavity of said base assembly and having a lower end supported by said second cable opposite end, and a third subassembly slidably received in said second tubular subassembly adapted to support an antenna.

2. The antenna mast structure of claim 1 wherein said third subassembly further includes a second fixed pulley, and a third cable having one end connected to said second subassembly, said third cable provided around said second pulley, and said third cable having an end opposite said one end inside an elongated cavity of said second subassembly and secured to a lower end of said third subassembly for supporting said third assembly so that both said second and third assemblies extend as a result of operating said windlass means.

3. The extendible antenna mast structure according to claim 2, wherein said windlass means comprises a winch mounted on said base assembly.

4. The extendible antenna mast structure of claim 3, wherein each of said tubular subassemblies and said base assembly are of rectangular cross-section.

5. The extendible antenna mast structure of claim 4, wherein said windlass means is non-reversible so as to require cranking for extending said subassemblies, and also requires cranking for collapsing said subassemblies.

6. The extendible antenna mast structure according to claim 5, further characterized by slide bearings supporting said telescoping tubular subassemblies, each said subassembly having a slide bearing provided at an upper end thereof and surrounding the subassembly which is slidably received therein, and wherein an inner end of each of said slidable subassemblies has a slide bearing provided externally of its lower end for slidably supporting said slidable subassembly in another subassembly.

7. The extendible antenna mast structure according to claim 6, wherein said cables are provided outside of said antenna mast structure except for the cable segments connected to the lower ends of said telescoping tubular subassemblies.

8. The extendible antenna mast structure according to claim 7, further characterized by motor means for driving said winch, said motor means being selectively connected to a source of power, and serving to act as a brake for preventing collapsing movement of said extendible telescoping structure subassemblies except when said power means is so connected to said winch.

* * * * *

UNITED STATES PATENT AND TRADEMARK OFFICE

CERTIFICATE OF CORRECTION

PATENT NO. : 6,041,558
DATED : March 28,2000
INVENTOR(S) : David P. Sylvestre

It is certified that error appears in the above-identified patent and that said Letters Patent is hereby corrected as shown below:

In the Specification:

Column 2,
Line 20, after "jacks", please insert -- J --.
Lines 36-37, please delete "base subassembly" and insert -- tubular base assembly --.
Line 65, before "fixed" please insert -- third --.

Signed and Sealed this

Nineteenth Day of June, 2001

*Attest:*

Nicholas P. Godici

*Attesting Officer*

NICHOLAS P. GODICI
*Acting Director of the United States Patent and Trademark Office*